US005918984A

United States Patent [19]

LaFleur et al.

[11] Patent Number: 5,918,984

[45] Date of Patent: Jul. 6, 1999

[54] COLLAPSIBLE BAG WITH HANDLE

[75] Inventors: Lee LaFleur; James E. Rozmarek, both of Manistee, Mich.

[73] Assignee: Custom Packaging Systems, Inc., Manistee, Mich.

[21] Appl. No.: 08/934,472

[22] Filed: Sep. 19, 1997

Related U.S. Application Data

[63] Continuation-in-part of application No. 08/861,933, May 22, 1997, abandoned, and a continuation-in-part of application No. 08/705,419, Aug. 29, 1996, Pat. No. 5,690,253.

[51] Int. Cl.[6] ..... B65D 33/10

[52] U.S. Cl. ..... 383/8; 383/16; 383/37; 383/120; 206/554

[58] Field of Search ..... 383/7, 8, 9, 10, 383/16, 36, 67, 77, 37, 104, 120, 904, 906, 907; 206/554

[56] References Cited

U.S. PATENT DOCUMENTS

| | | | |
|---|---|---|---|
| 2,562,389 | 7/1951 | Piazze | 383/33 X |
| 3,143,277 | 8/1964 | LaFleur | 383/120 X |
| 3,633,330 | 1/1972 | Leonard | 206/554 X |
| 4,312,392 | 1/1982 | Sekiguchi | 383/8 |
| 4,393,910 | 7/1983 | Rasmussen | 383/8 |
| 4,416,376 | 11/1983 | Scheffers et al. | 383/37 X |
| 4,491,959 | 1/1985 | Loefberg | 383/104 X |
| 4,524,459 | 6/1985 | Titchenal | 383/37 |
| 4,561,107 | 12/1985 | Herder | 383/37 |
| 4,596,040 | 6/1986 | LaFleur et al. . | |
| 4,712,684 | 12/1987 | Boeckmann | 383/37 X |
| 4,859,082 | 8/1989 | Llorens et al. | 383/8 |
| 5,096,305 | 3/1992 | Rimondi et al. | 383/37 |
| 5,350,239 | 9/1994 | Strand et al. | 383/7 |

FOREIGN PATENT DOCUMENTS

| | | | |
|---|---|---|---|
| 615653 | 2/1961 | Canada | 383/94 |
| 581393 | 2/1994 | European Pat. Off. | 383/111 |
| 0139383 | 5/1990 | Japan | 383/904 |
| 1717490 | 3/1992 | Russian Federation | 383/8 |
| 332823 | 11/1958 | Switzerland | 383/26 |
| 453872 | 6/1968 | Switzerland | 383/93 |
| 1465695 | 2/1977 | United Kingdom | 383/119 |
| 1402962 | 8/1990 | United Kingdom | 383/10 |

*Primary Examiner*—Jes F. Pascua

*Attorney, Agent, or Firm*—Reising, Ethington, Barnes, Kisselle, Learman & McCulloch, P.C.

[57] ABSTRACT

A plurality of collapsible bags are integrally formed in a tubular blank of a flexible material with a perforated portion disposed between adjacent bags to facilitate separating them. When formed, adjacent bags are connected in end-to-end relationship and lie generally flat such that the elongate blank may be wrapped around itself forming a roll of the bags or the bags may be pleated or accordion folded flat within a container whereby they may be individually removed from the container for use. Handles are preferably integrally formed with each bag extending from adjacent the top wall of the bag. A spout is preferably also integrally formed with the bag to facilitate filling and emptying of the bag. The bags are particularly suited to contain liquids or frozen liquids and are preferably made of a food-grade plastic film material suitable to contain various foods or beverage products. The bags may each be received in a separate container to support a filled bag. To facilitate emptying a bag received in a container, the container may be received on a base tray having an inclined surface to tilt the container so that the contents of the bag collect at a lowest portion of the bag. A spout support may be provided to hold the spout open and to prevent the bag from collapsing around the spout during filling or emptying of the bag. To facilitate lifting, hanging or moving a bag, a bag carrier may be provided having a U-shaped channel constructed to receive a rod over which the handles of the bag are received.

19 Claims, 10 Drawing Sheets

FIG. 1
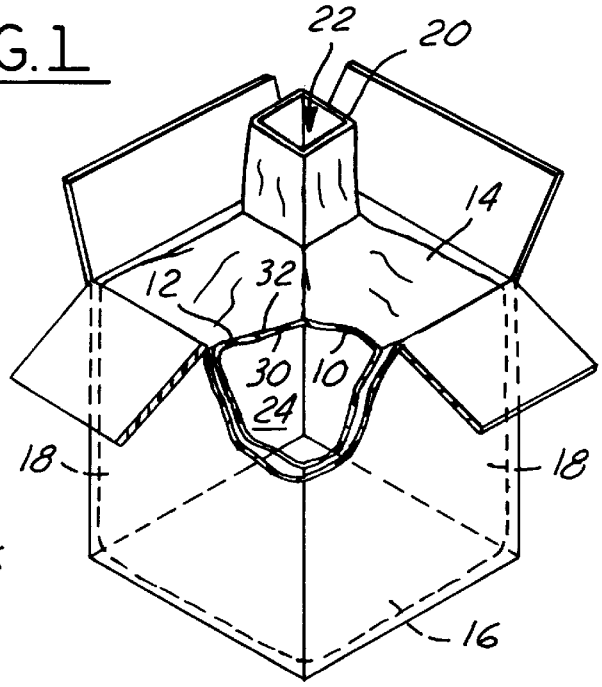
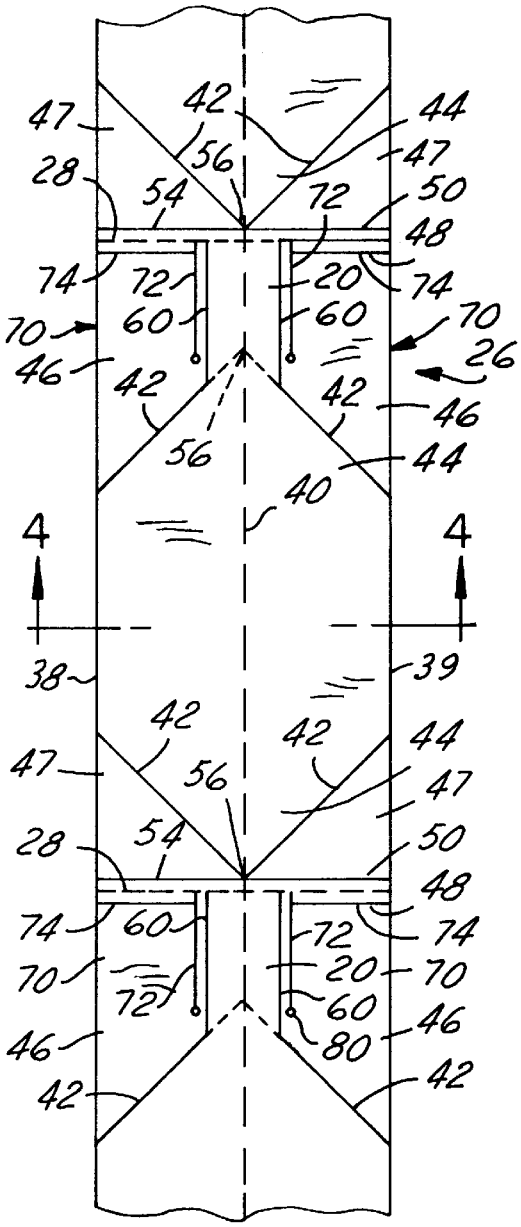
FIG. 3
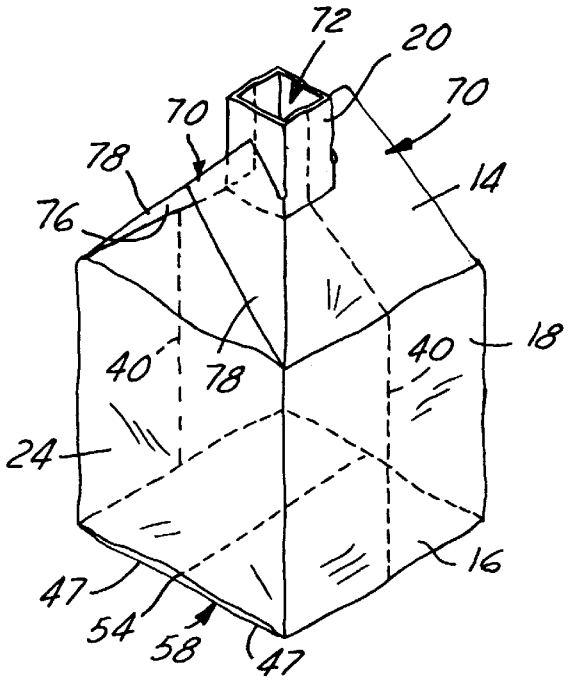
FIG. 2

COLLAPSIBLE BAG WITH HANDLE

REFERENCE TO A COPENDING APPLICATION

This is a continuation-in-part of U.S. patent application Ser. No. 08/861,933, filed on May 22, 1997 and abandoned in favor of this continuation-in-part application, U.S. patent application Ser. No. 08/705,419, filed on Aug. 29, 1996 and issued as U.S. Pat. No. 5,690,253 on Nov. 25, 1997.

FIELD OF THE INVENTION

This invention relates to shipping and storage containers and more particularly to a web of a plurality of separable collapsible bags, a method of making them, a carrier for the bags and an outlet adapter for the bags.

BACKGROUND OF THE INVENTION

Previously, liquids and frozen liquids have been shipped and stored in drums or similar containers and typically in five-gallon cylindrical plastic containers. These containers are circular in cross section and hence, do not fit well against adjacent containers resulting in an inefficient use of storage space or shipping space when they are disposed side-by-side. It is also somewhat difficult and messy to discharge the contents from the large open top of the container thereby leading to spilling or contamination of the contents of the container during discharge. This is especially true when used with viscous or frozen products which are not easily poured from the container. Further, these containers can be expensive and must be thoroughly cleaned between uses to avoid contaminating subsequent contents thereof.

Some bulk containers have been made from flexible material and may contain as much as a ton or more of material. One such bag, as disclosed in U.S. Pat. No. 4,596,040, provides a bulk container with gusseted side walls, reinforced ends and a separate spout attached to the container.

SUMMARY OF THE INVENTION

A plurality of collapsible bags with a spout and handles are integrally formed from an elongate tubular blank or web of a flexible material with a perforated portion disposed between adjacent bags to facilitate separating them. When formed, adjacent bags are connected in end-to-end relationship and lie generally flat such that the elongate blank may be wrapped around itself forming a roll of the bags or the bags may be pleated or accordion folded flat within a container whereby they may be individually removed from the container for use.

When filled, each bag preferably has a generally cubical configuration with integral and generally rectilinear top, bottom and side walls. Preferably, the bags are received in a complementarily shaped box such as a cardboard box or the like, to prevent them from outwardly bulging when filled and to facilitate stacking, storing and handling of them in use. The generally cubical configuration permits efficient side-by-side storage or shipment of the bags with a minimal amount of wasted space between bags. To facilitate emptying a filled bag received within a box, a base tray may be provided having an inclined lower surface to tilt the box so that one corner of the box is disposed below the other corners providing a sump or lowest corner of the box from which the contents of the bag may be withdrawn, such as by a siphon or pump to facilitate completely emptying the bag.

A flexible and collapsible spout is preferably integrally formed extending from the top wall and defining an opening into the interior of the bag through which the bag can be filled and emptied. The spout facilitates discharge of the contents by directing the contents through a reduced flow area opening for a more controlled discharge to help prevent spilling or contaminating the contents of the bag. A wire frame support may be provided for the spout to hold the spout open and to prevent the spout and bag from collapsing during filling and emptying of the bag. A pair of flexible and collapsible handles preferably extend from the top wall of the bag adjacent to the spout to facilitate handling, filling and emptying of the bag. The handles are preferably integral with the bag and formed on opposed sides of the spout. In one form of the bag, a central handle is provided between the spout and an upper edge of the bag. Preferably, excess material is provided adjacent the bottom of the bag which may be gripped by an operator to facilitate holding the bag upside down to empty it. If desired, a portion of this extra material may be removed or a slit formed therein to provide a handle adjacent the bottom of the bag to facilitate handling and emptying the bag.

A bag carrier may be provided to firmly engage the handles of the bag to facilitate hanging or supporting the bag as it is being filled or to facilitate moving the bag. The carrier preferably has a U-shaped channel which at least partially receives a rod in the handles to pinch and frictionally retain the handles between the rod and the carrier and thereby support the bag in use.

To facilitate emptying the bag, a removable adapter with a valve assembly may be disposed in the bag spout. Also, the flexible bags are collapsible and can be put through rollers to squeeze out the contents of the bag to facilitate completely discharging viscous or semi-frozen liquids such as bacon fat, hot fudge, soup stocks, syrups and other freezable liquids. Passing the bag through the rollers removes substantially all of the contents of the bag to minimize losses or wasted material. The bags are relatively inexpensive and may be discarded after use or cleaned and recycled.

Objects, features and advantages of this invention include providing a plurality of flexible, collapsible bags particularly suited for the storage and shipment of liquids or frozen liquids which are integrally formed from a continuous web of a flexible material, have handles integrally formed therewith in at least one end of each bag and preferably adjacent both the top and bottom walls, may be supported or hung by its handles on a carrier, can be easily separated from adjacent bags for individual use, can be wound into a roll for more efficient storage of unused bags, can be pleated or accordion folded flat and received within a container to facilitate removing individual bags from the container, can be received within a box or other container to facilitate handling, storing and shipping, enables an efficient use of shipping or storage space, can be received on an inclined base tray to facilitate substantially completely emptying the bag, can be fed through rollers or some other press mechanism to facilitate discharge of the contents of a bag, can be formed with an integral spout to facilitate discharge of the contents, can be provided with a spout support to hold the spout open and prevent the bag from collapsing, have a generally cubical configuration when expanded to more efficiently ship and store the contents of the bags either side-by-side or stacked, are of relatively simple design and economical manufacture, and are relatively inexpensive.

BRIEF DESCRIPTION OF THE DRAWINGS

These and other objects, features and advantages of this invention will be apparent from the following detailed description of the preferred embodiments and best mode, appended claims and accompanying drawings in which:

FIG. 1 is a perspective view partially broken away to illustrate a collapsible bag received within a container and constructed according to the present invention;

FIG. 2 is a perspective view of a collapsible bag according to the present invention;

FIG. 3 is a plan view of a generally continuous tubular blank of flexible material from which a supply of integral collapsible bags are formed;

DETAILED DESCRIPTION OF THE PREFERRED EMBODIMENTS

Figure 4:
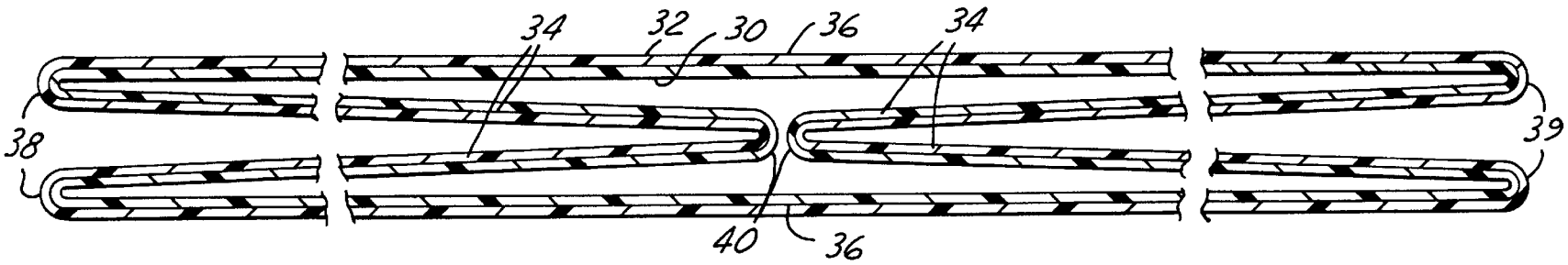
FIG. 4 is a sectional view taken along line 4—4 of FIG. 3.

Referring in more detail to the drawings, FIGS. 1 and 2 illustrate a collapsible bag 10 according to the present invention, and received within a container 12. The bag 10 has a generally cubicle configuration with generally rectilinear top 14, bottom 16 and side 18 walls with an integral spout 20 extending from the top wall 14 and providing an opening 22 into the interior 24 of the bag 10 to facilitate filling and emptying the bag 10. As shown in FIG. 3, a plurality of bags 10 may be integrally formed from an elongate tubular web or blank 26 of a flexible material separated by a perforated line portion 28 between adjacent bags 10 whereby individual bags 10 may be separated along the perforated line 28 from an adjacent bag 10 for individual use. The integral spout 20 is collapsible and may be tied off or sealed to prevent the contents of the bag 10 from leaking therethrough and may be tucked down inside the container 12.

The tubular blank 26 is preferably formed of a plastic material suitable for handling foods, and particularly liquids, frozen liquids and granular or other dry flowable products and of sufficient strength to enable a bag 10 to contain a load of up to about 60 pounds without rupturing. For example, the bag 10 may be made from a plastic film impervious to water such as polyethylene or polypropylene plastic film generally having a thickness in the range of about 4–10 mils. Preferably, the plastic film of the tubular blank 26 is formed of two coextruded and integral layers 30, 32 of material with an inner layer 30 received interiorly of an outer layer 32 and having a lower melting temperature than the outer layer which enables the inner layer 30 to be heat sealed at a lower temperature than the outer layer 32. Preferred materials for the coextruded film are metallocine for the inner layer 30 which can be heat sealed at a temperature below 300° F., and generally between 280° F. and 290° F., and high density polyethylene for the outer layer 32 which can be heat sealed at a temperature of between about 360° F. to 400° F. Thus, when the plastic film of blank 26 is folded it is possible to heat seal only adjacent inner layers 30 of material to each other without sealing the overlapping outer layers 32 of polyethylene together by heat sealing at a temperature below that required to heat seal the polyethylene and high enough to heat seal the metallocine inner layer.

To form the generally cubical configuration of each bag 10, the tubular blank 26 is preferably folded to provide a pair of gusseted panels 34 received inwardly of a pair of overlying flat panels 36. When folded in this configuration, as shown in FIG. 4, the flat panels 36 have a pair of generally opposed and substantially parallel side edges 38, 39 with the fold lines 40 of the gusseted panels 34 lying parallel to and substantially midway between them.

Figure 5:
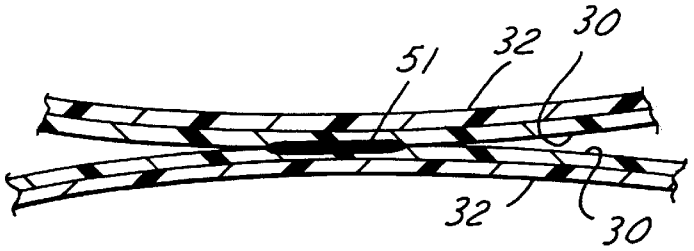
FIG. 5 is a partial sectional view illustrating a heat seal between adjacent interior layers of material.

To provide a generally rectilinear top wall 14 and a generally rectilinear bottom wall 16 which are generally flat when the bag 10 is filled, the blank 26 when folded as shown in FIG. 4 is heat sealed along inclined and generally straight line segments 42 forming triangular portions 44 as well as overlapping portions 46, 47 adjacent opposed upper and lower ends 48, 50 of each bag 10. More specifically, along the straight line segments 42 only the interior layers 30 of the flat panels 36 and gusset panels 34 are joined by a heat seal 51, as shown in FIG. 5. As previously discussed, this is accomplished by heat sealing at a temperature of about 300° F. which is sufficient to heat seal together the adjacent metallocine inner layers but is a temperature below that required to heat seal together the outer layers 32 of polyethylene. Thus, when the blank 26 is folded as shown in FIG. 4, the inner layers 30 may be sealed along the straight line segments 42 with the upper and lower flat panels 36 each heat sealed to only the lapped portions of its immediately adjacent gusset panels 34 while not heat sealing the overlapped adjacent gusset panels 34 together. This simplifies making the bag by enabling a single heat sealer bar to simnultaneously form a pair of overlapped heat sealed segments 42 without sealing together the adjacent overlapped gusset panels and without placing a barrier between them to prevent them from being adhered together. This also enables the bag to be made with the tubular blank in a flat and folded condition as shown in FIGS. 3 and 4 and supported on a generally planar surface and without manipulating portions of the tubular blank. Further, at the bottom end 50 of the bag 10 each layer 30, 32 of the overlapping portions 47 of all of the panels are heat sealed together along a line 54 transverse to the axis of the blank 26 and adjacent the apex 56 of the triangular portions 44. This is done at a temperature of about 360° F. to 400° F. to enable the outer layers 32 of material of the panels to be heat sealed as well as the inner layers 30. This will provide an additional layer 58 of film overlapping the bottom wall 16 of the bag 10 when expanded as best shown in FIG. 2. This addition layer 58 of film reinforces the bottom wall of the bag.

When heat sealed in this manner, one triangular portion 44 is provided adjacent each flat panel 36 and each gusset panel 34 providing four triangular portions 44 for each of the top wall 14 and bottom wall 16. Adjacent sides of adjacent triangular portions 44 are connected together along the heat seal lines 42 so that when the bag 10 is expanded they form generally rectangular and preferably substantially square ends 14, 16 which are interconnected by generally rectangular side walls 18. Preferably, to provide a top wall 14 and bottom wall 16 which are generally flat when the bag 10 is filled, the triangular portions 44 are substantially identical isosceles triangles each with a substantially 90° angle at its apex 56 and a pair of substantially 45° acute angles at its base.

Preferably, a spout 20 is formed adjacent at least the top wall 14 of the bag 10 to facilitate filling and emptying the bag 10. Preferably, the spout 20 is integrally formed with the bag 10 by terminating the heat seal lines 42 of the triangular portions 44 forming the top wall 14 short of their apexes 56. Then, the interior layer 30 of each flat panel 36 is heat sealed to a portion of the interior layer of only its immediately adjacent gusset panels 34 along a pair of straight and generally parallel lines 60 extending from the triangular portions 44 to the upper end 48 of the bag 10. Preferably, the spout 20 extends several inches beyond the point where the apex 56 of the triangular portion 44 would be if extended so that the spout 20 extends sufficiently above the top wall 14 of the bag 10 when it is expanded so that it may extend above the top of the container 12 when desired such as for freeing and emptying the bag.

Figure 6:
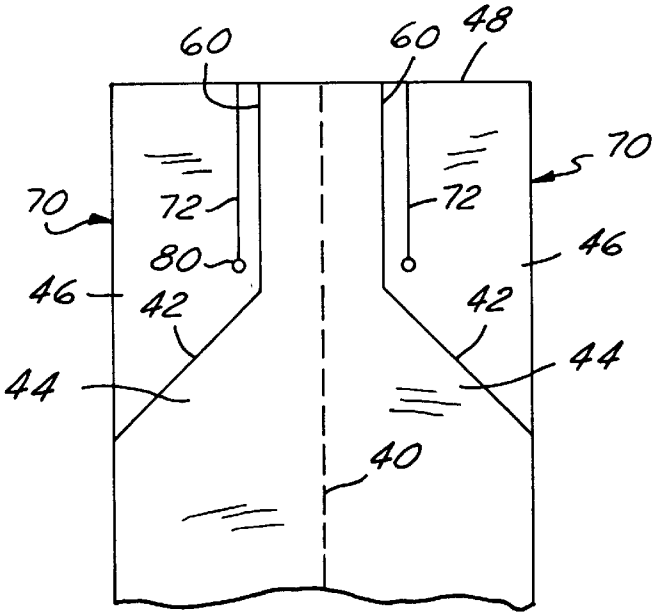
FIG. 6 is a plan view of an upper portion of a bag illustrating the construction of the spout and handles.

Preferably, a pair of handles 70 are formed on either side of the spout 20 by providing a slit 72 through each panel 34, 36 of the blank 26 extending from the upper end 48 of the bag 10, exteriorly of and parallel to the heat seal lines 60 forming the spout 20 and down towards the triangular portions 44 forming the top wall 14 as shown in FIG. 6. The upper portion of each handle 70 is preferably sealed through each layer 30, 32 of material along line 74, as shown in FIGS. 2 and 3, to provide a bight 76 and two runs 78 which are integral with the bag 10. Preferably, to inhibit the handle 70 from tearing adjacent the slit 72 a circular opening 80 is provided adjacent the end of the slit 72. To facilitate separation of the bags 10, the perforated line portion 28 is provided between the heat seal line 74 of each handle 70 and the heat seal line 54 adjacent the bottom end 50 of the bottom wall of the adjacent bag 10.

Figure 7:
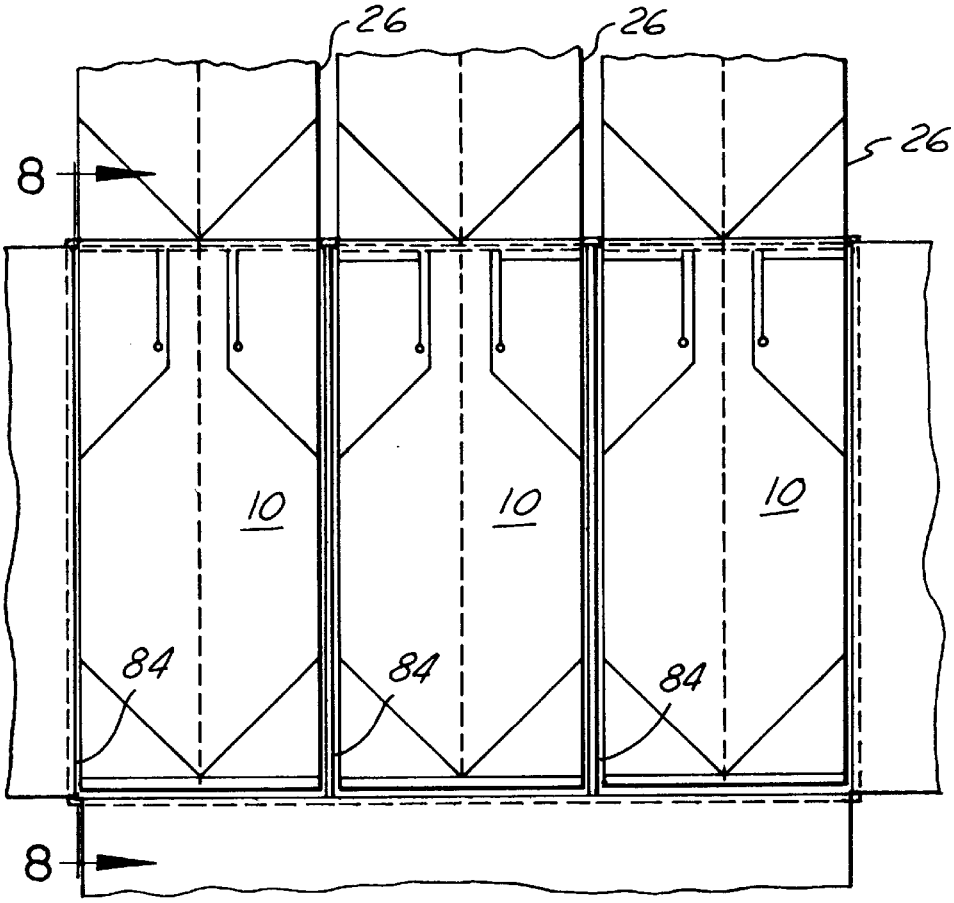
FIG. 7 is a plan view of a container having dividers providing three separate chambers each chamber constructed to receive a supply of bags folded flat therein.
Figure 8:
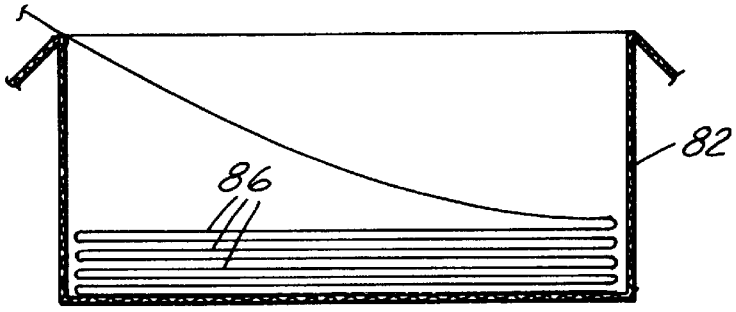
FIG. 8 is a semi-diagrammatical view taken along line 8—8 of FIG. 7.
Figure 33:
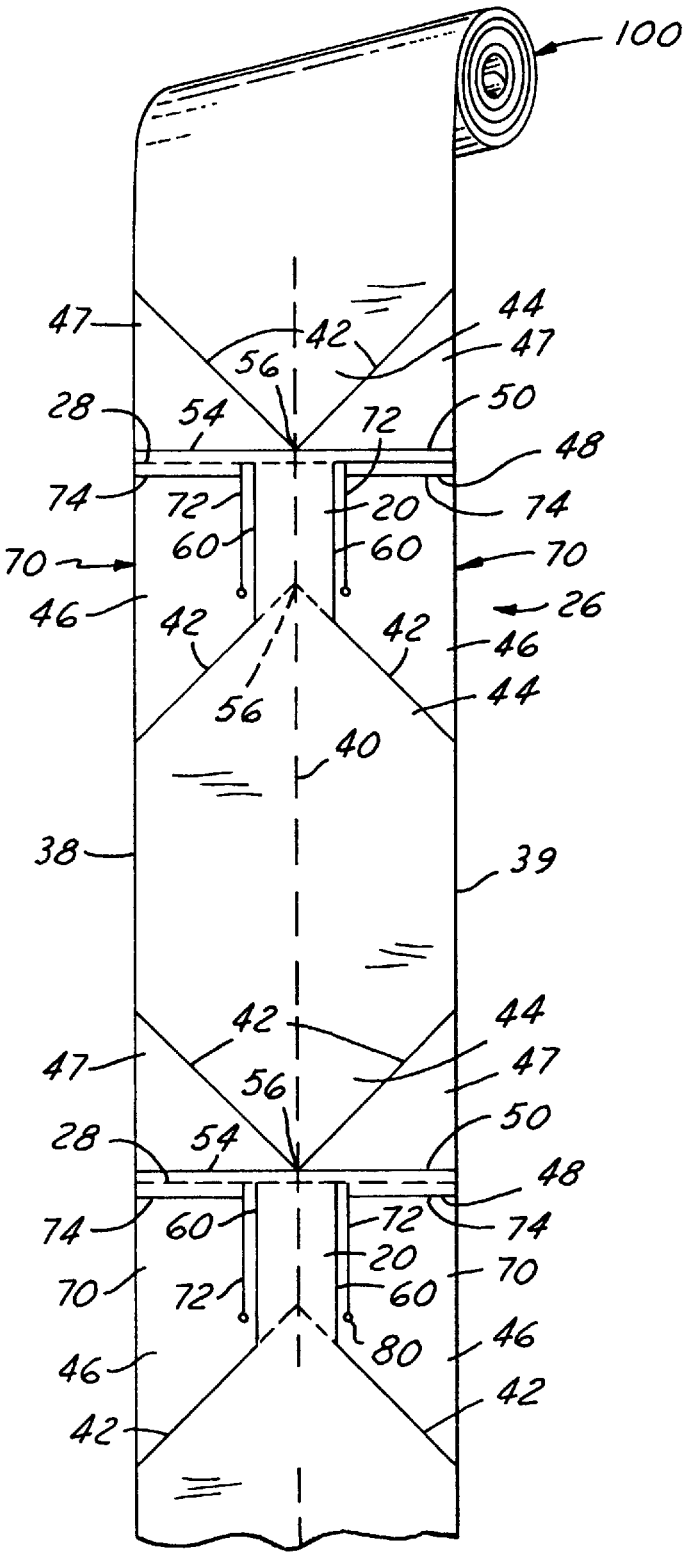
FIG. 33 is a semi-diagrammatical perspective view of a tubular blank of a plurality of bags wound on itself to provide a cylindrical roll of a plurality of bags.

After the bags 10 are formed the elongate web or blank 26, as shown in FIG. 33, may be wound on itself to provide a cylindrical roll 100 of bags 10 or, as shown in FIGS. 7 and 8, the blank 26 may be pleated or accordion folded flat in a stack and received within a container 82 whereby a bag 10 may be pulled from the container 82 and separated from the adjacent bag 10 along the perforated portion 28. As shown in FIG. 7, a preferred container 82 has dividers 83 providing three separate compartments 84 each constructed to receive a blank 26 comprising a separate supply of a plurality of bags 10 with each blank 26 folded preferably along each perforated line 28 so that each bag 10 forms an individual layer 86 within a compartment 84. If desired, the container 82 may have only one opening whereby the supply of bags 10 in each of the compartments 84 are fed through the same opening as three separate and overlapped webs of bags each available for use. Alternatively two or more separate webs can be overlapped downstream of the container or separate stacks of bags may be available for use. This insures a continuous supply of bags available for use at a common location even when one stack is exhausted or used up and while it is being replaced by a new stack of bags.

In use, an individual bag 10 is removed from the blank 26 by severing it from the blank along the perforated line 28 and can be received within a container 12 as shown in FIG. 1 preferably before filling the bag. When expanded and filled, the bag 10 has a generally cubical configuration and conforms to the interior surfaces of the container 12. The spout 20 may be pulled through an opening in the top of the container 12 or, if used with an open top container 12, the spout 20 may be extended to facilitate filling the bag 10 and thereafter closed off and tied to seal the bag 10. The bag 10 may be suspended by its handles 70 to facilitate moving the bag 10 or filling and emptying of the bag 10. To facilitate discharge of viscous or semi-frozen liquids, the bag 10 may be removed from the container 12 and passed through the nip of a pair of rollers or some other press mechanism to squeeze out substantially all of the contents of the bag 10. Thereafter, the bag 10 may be discarded or cleaned and recycled.

In an alternate embodiment of the invention, as shown in FIGS. 9–12, the perforated line 28 separating adjacent bags 100 is spaced from the spout 20 and a heat seal line 104 extends completely across each bag 100 generally transverse to the longitudinal axis of the tubular blank 26. This heat seal line 104 forms the bight of the handles 70 adjacent each side of the spout 20 and, in combination with a slit 106 which defines the upper edge of the spout 20, defines a central handle 108 between the upper end of the bag 100 and the upper edge of the spout 20. The central handle 108 may facilitate filling or emptying the bag 100 and lifting and moving a filled bag 100.

Figure 9:
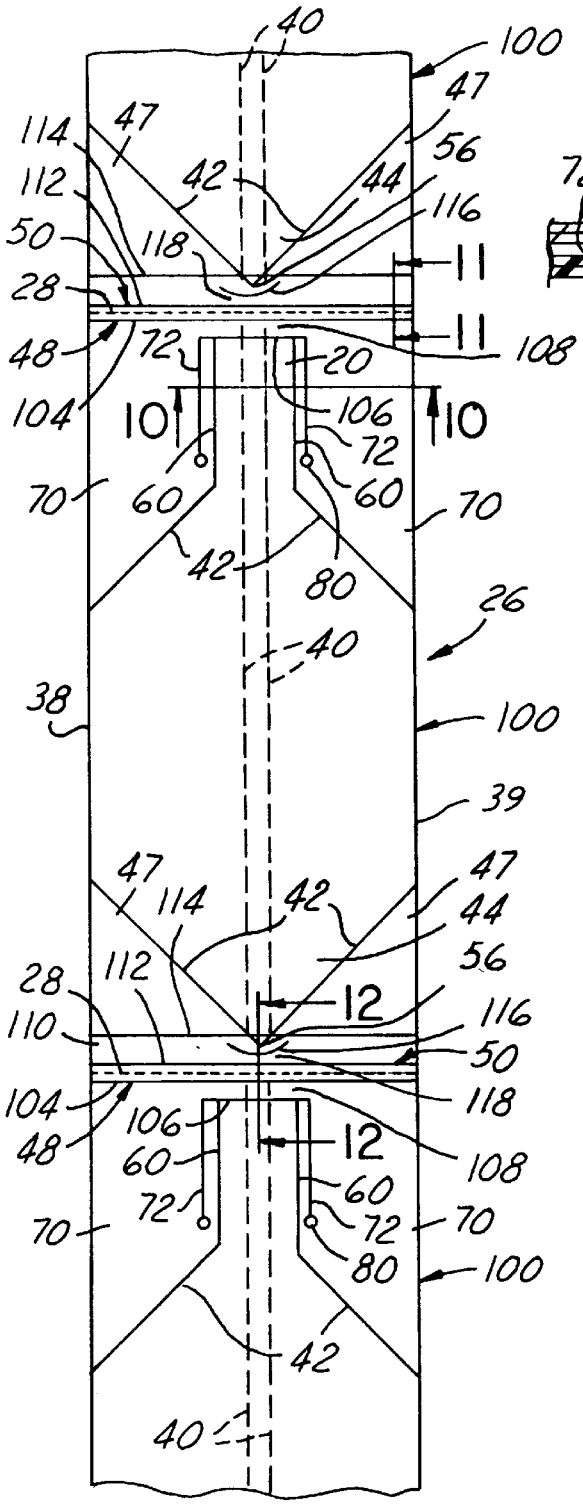
FIG. 9 is a plan view of a generally continuous tubular blank of flexible material from which a supply of integral collapsible bags are formed according to an alternate embodiment of the invention.
Figure 10:
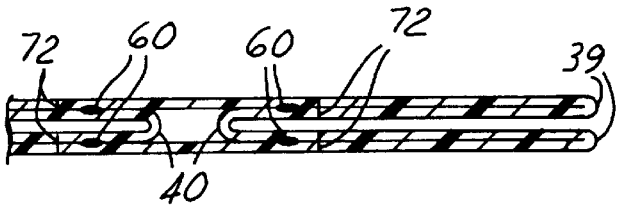
FIG. 10 is a sectional view along line 10—10 of FIG. 9.
Figure 11:
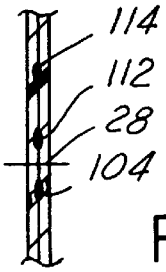
FIG. 11 is a sectional view taken along line 11—11 of FIG. 9.
Figure 12:
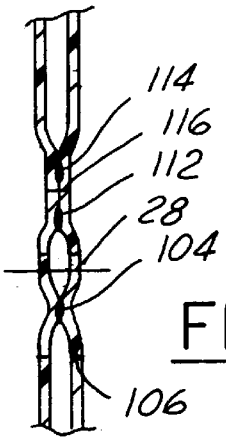
FIG. 12 is a sectional view taken along line 12—12 of FIG. 9.
Figure 13:
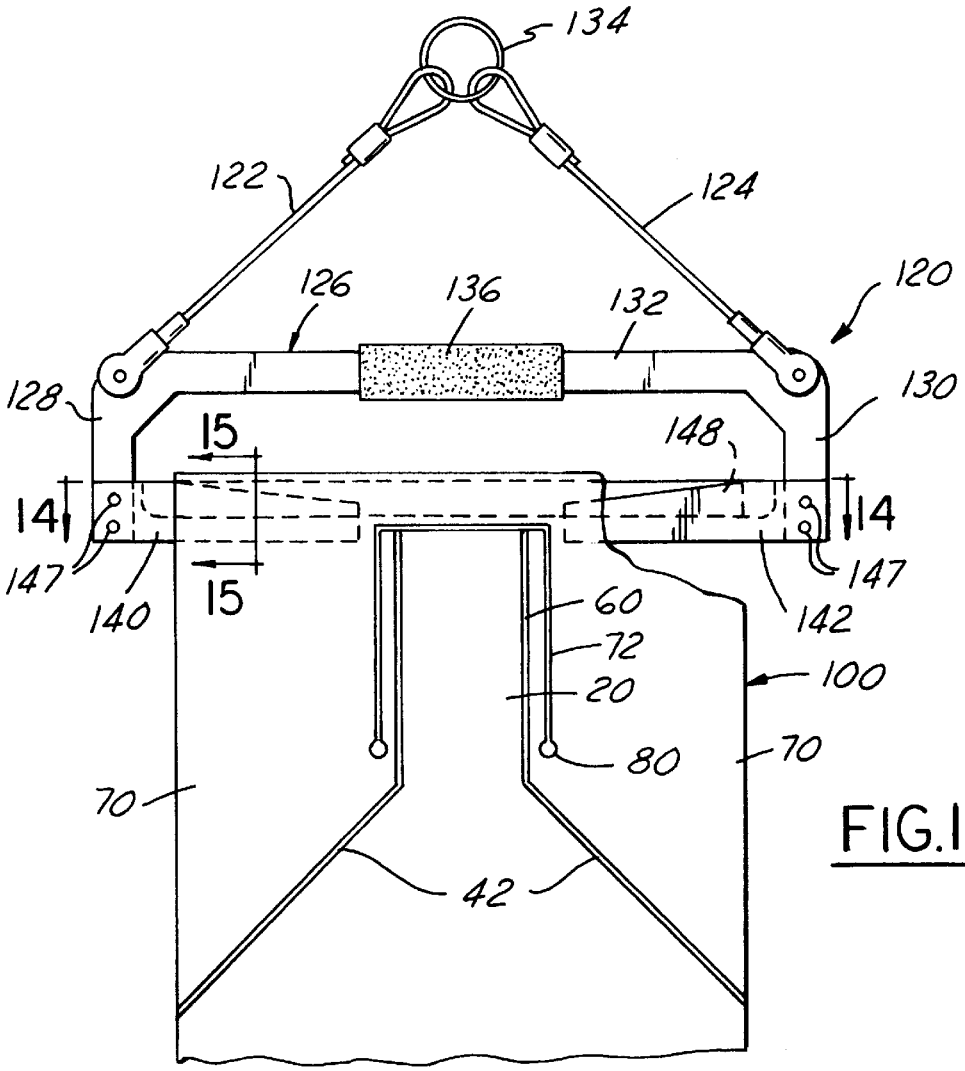
FIG. 13 is a plan view illustrating a bag releasably retained on a carrier of the invention.
Figure 14:
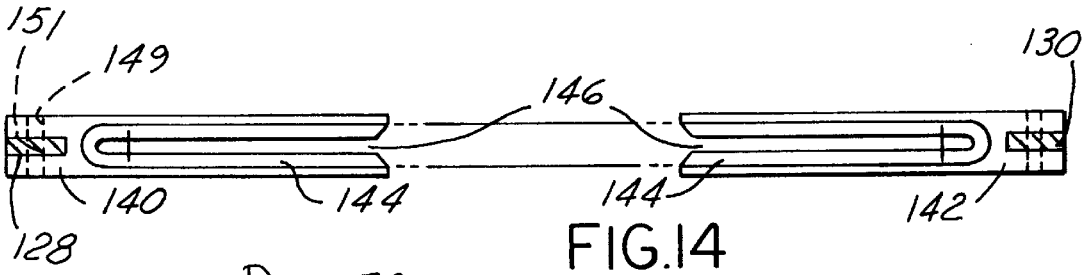
FIG. 14 is a sectional view along line 14—14 of FIG. 13.

Preferably, as shown in FIGS. 9, 11 and 12, each bag 100 is formed with a panel 110 of extra material adjacent the bottom 50 of the bag 100 and defined between a pair of parallel heat seal lines 112, 114 with one heat seal line 112 at the bottom end 50 of the bag 10 and the other heat seal line 114 formed generally adjacent the apex 56 of the triangular portions 44 forming the bottom wall 16 of the bag 100 and spaced from the heat seal 112. This panel 110 may be used as a handle and gripped by the operator to facilitate turning and holding the bag 100 upside down to facilitate emptying the bag 100 through the spout 20. If desired, an arcuate slit 116 may be cut through the panel 110 to form a handle 118 which may be grabbed by the operator or by which the bag 100 may be supported when emptying the bag 100.

Figure 22:
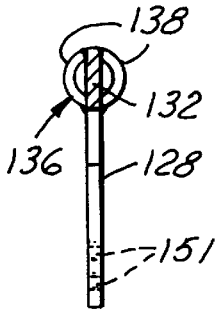
FIG. 22 is an end view of the U-shaped body of FIG. 21.

As shown in FIGS. 13–22, a carrier 120 may be used to support the bag 100 by its handles 70 to facilitate filling, emptying and/or moving the bag 100. The carrier 120 has a pair of chains or flexible cables 122, 124 each fixed at one end to an inverted U-shaped body 126 having spaced apart depending arms 128, 130 interconnected by and integral with a straight bar 132. The cables 122, 124 are connected at their other end to a ring 134 which may be received on a hook or the like to hang or support the carrier 120 and associated bag 100. A handle 136 for the carrier 120 may be provided by cutting a short metal tube in half and then welding the halves of the tube 138 to opposed sides of the bar 132, as shown in FIG. 22.

Figure 15:
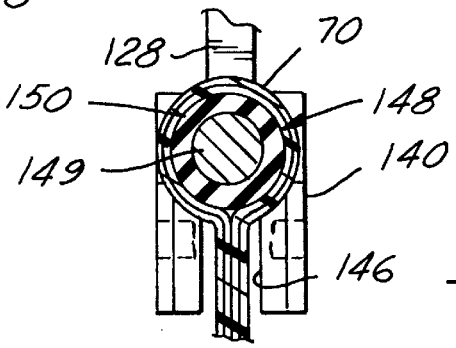
FIG. 15 is a sectional view along line 15—15 of FIG. 13.
Figure 16:
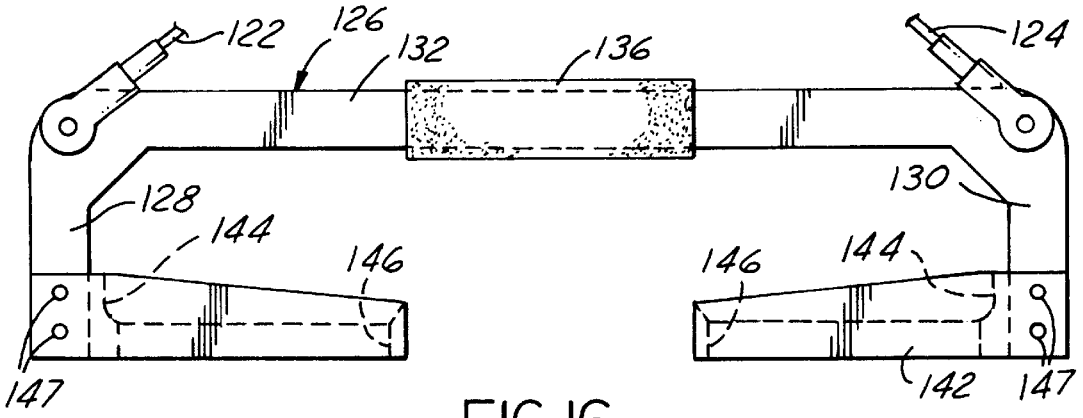
FIG. 16 is a fragmentary side view of the carrier of FIG. 13.

A pair of channel members 140, 142 each defining a U-shaped channel 144 and having an elongate slot 146 through the bottom of the channel 144 are preferably fixed to the arms 128, 130 by rivets 147 received in aligned holes 149, 151 through each channel member 140, 142 and its associated arm 128, 130 or otherwise securely fixed to its associated arm. The channels 144 are constructed to slidably receive a rod assembly 148 on which the handles 70 of the bag 100 are received so that the weight of the contents of the bag 100 pulls downwardly on the rod assembly 148 to firmly seat the rod assembly 148 within the channel 144. As shown in FIG. 15, the material of the handles 70 is pinched (and frictionally engaged) between the rod assembly 148 and the channel members 140, 142 and extend through the slot 146 through the bottom of the channel 144. When so pinched, the material of the handle 70 supports and carries the weight of the bag 100 and its contents as opposed to the heat seal 104 which would have to be strong enough to support the bag 100 if the bag 100 were merely hung from a rod, lifting tine or the like. Thus, the tensile strength of the bag material, which is considerably higher than the strength of the heat seal 104, limits the load which may be carried by the handles 70 of the bag. Generally, bags made of the material specified can withstand loads of up to 1000 pounds or more.

Figure 17:
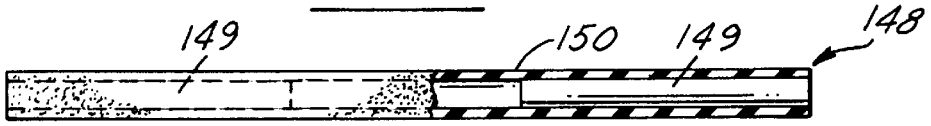
FIG. 17 is a side view partially in section of a rod assembly of the carrier.
Figure 18:
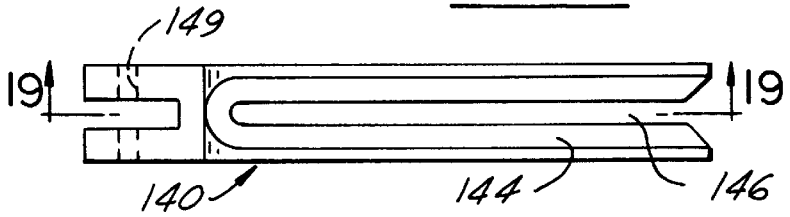
FIG. 18 is a top view of a channel member of the carrier.
Figure 19:
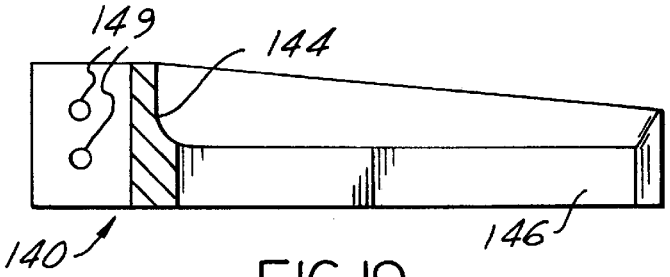
FIG. 19 is a cross sectional view along 19—19 of FIG. 18.
Figure 20:
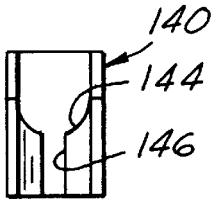
FIG. 20 is an end view of a channel member.
Figure 21:
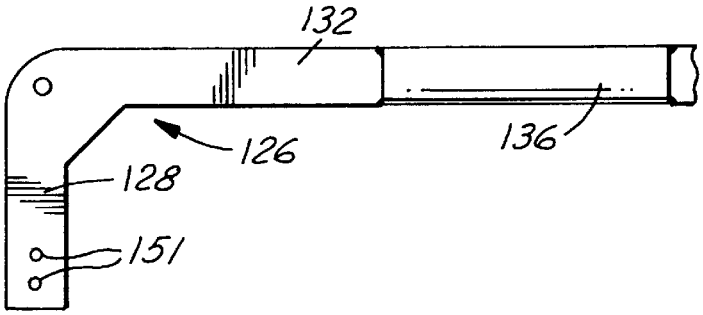
FIG. 21 is a partial side view of a U-shaped body of the carrier.

As shown in FIG. 17, the rod assembly 148 is preferably two separate pins or rods 149 telescopically received in a rubber tube 150 which when received in the channel 144 has an interference fit to frictionally retain the bag handles 70 within the channel members 140, 142. The rubber tube 150 is preferably formed of a silicone or urethane rubber. Alternately, a single rod may be received in both handles 70 of the bag 100 and in the channel 144 of each channel member 140, 142. This single rod is also preferably received in a rubber tube which, when received in the channels 144, has an interference fit to frictionally retain the handles 70 in the channel members 140, 142.

Figure 23:
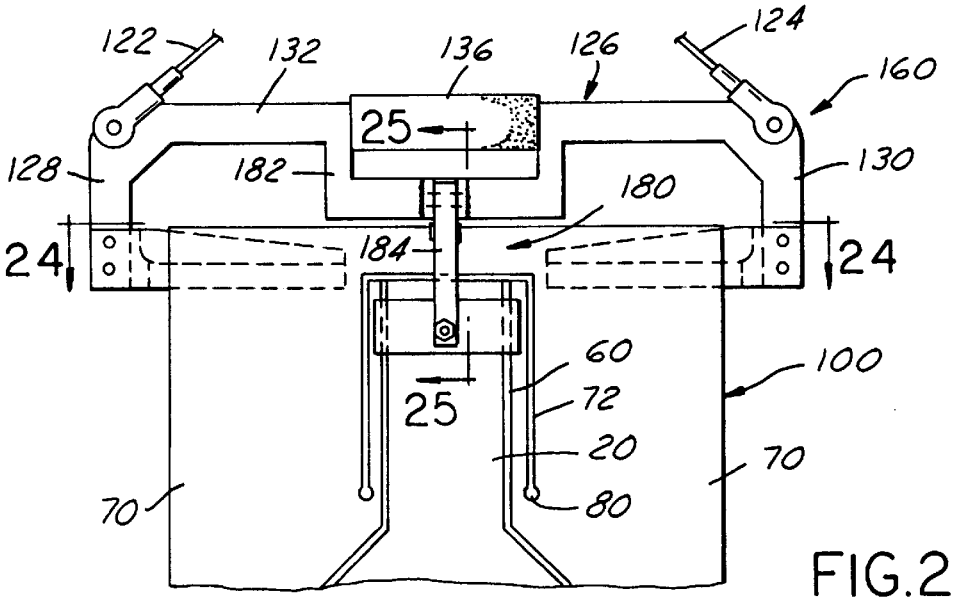
FIG. 23 is a partial side view of an alternate embodiment of a carrier of the invention.
Figure 24:
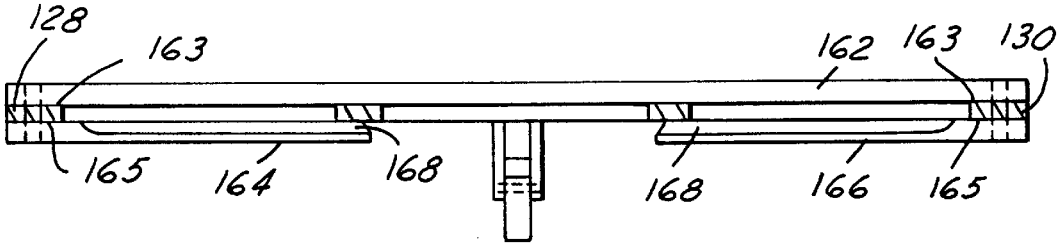
FIG. 24 is a sectional view taken along line 24—24 of FIG. 23.
Figure 25:
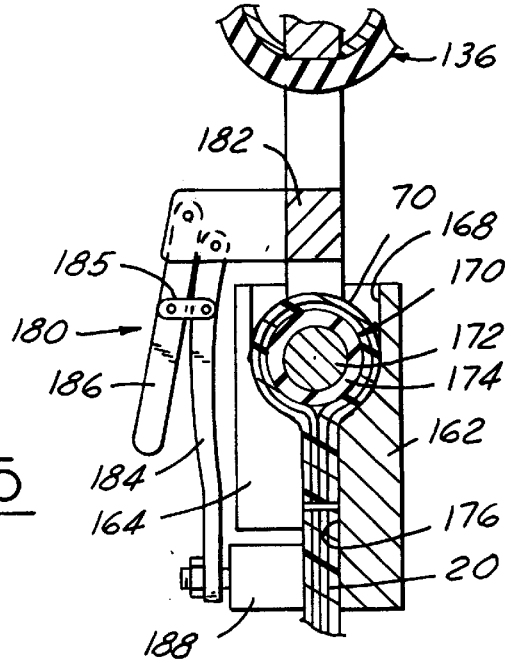
FIG. 25 is a sectional view taken along line 25—25 of FIG. 23.

In a second embodiment of the carrier 160, as shown in FIGS. 23–25, a back bar 162 is connected to the rear face 163 of each arm 128, 130 and with a pair of spaced apart front bars 164, 166 fixed to the front face 165 of each arm 128, 130 defines a pair of channels 168 each constructed to receive an end of a rod assembly 170 with the handles 70 of the bag 100 received on the rod assembly 170 to support the bag 100. The arms 128, 130 space the front bars 164, 166 from the back bar 162 to provide the slot 174 through the channels 168 through which the handles 70 of the bag 100 are received when the rod assembly 170 is loaded in the channels 168. Preferably, the rod assembly 170 has a single long pin 172 telescopically received with an interference fit in a rubber hose or tube 174.

Figure 26:
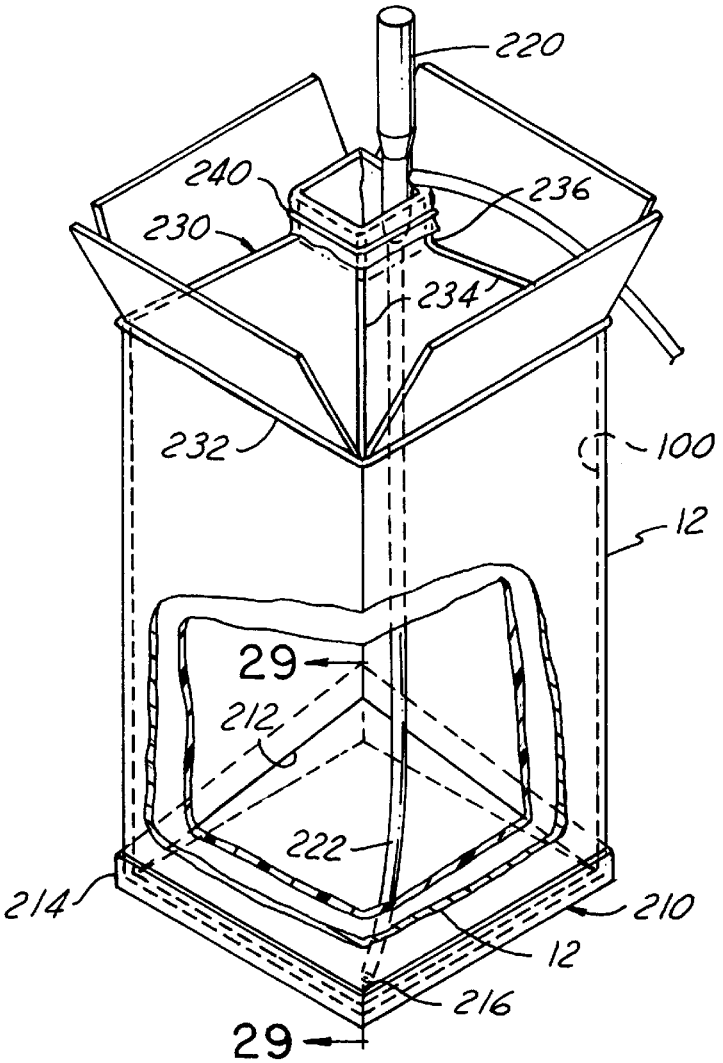
FIG. 26 is a perspective view partially broken away to illustrate a collapsible bag received within a rigid container which is disposed on an inclined base tray and which has a wire frame support retaining the spout in an open position to receive an inlet tube of a pump into the bag.
Figure 28:
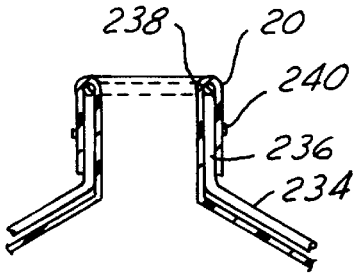
FIG. 28 is a sectional view taken along line 28—28 of FIG. 27.
Figure 27:
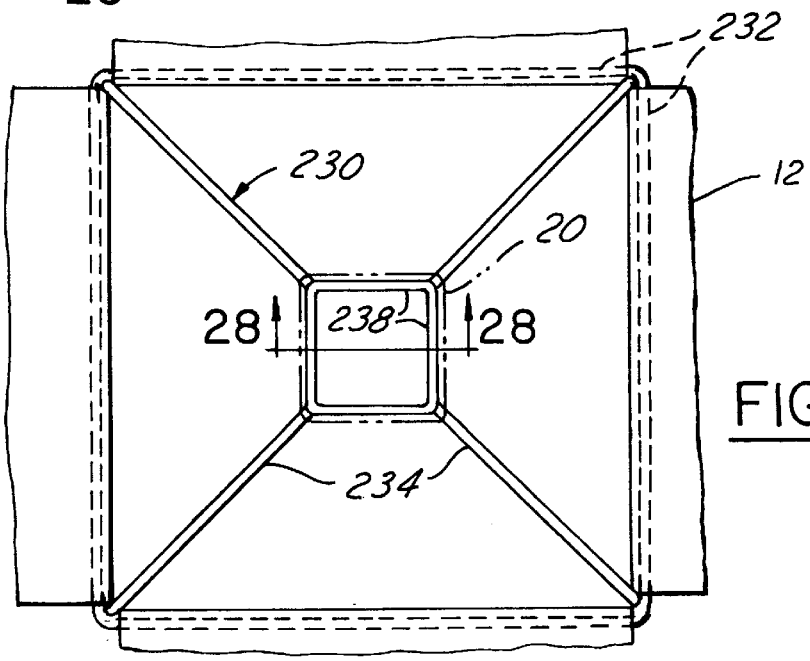
FIG. 27 is a top view illustrating the wire frame spout support on the container.

A toggle actuated clamp 180 is mounted on a support bar 182 spaced from the handle 136 of the carrier 160. The clamp 180 has a clamp arm 184 connected by a pivoted link 185 to an actuating lever 186 to move the clamp 180 between open and clamped positions. The clamp arm 184 has a clamp pad 188 at its working end constructed to clamp the spout 20 of the bag 100 against the back bar 162, which, as shown in FIG. 26, in its central position extends below the front bars 164, 166. When the clamp 180 is in its open position, the clamp arm 184 and pad 188 are swung out of the to way by actuating the lever 186 to facilitate loading a bag 100 onto the carrier 160.

Figure 31:
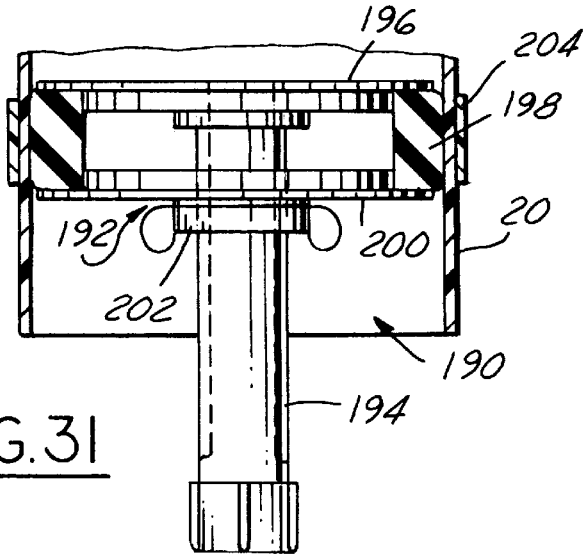
FIG. 31 is a sectional view of a removable adapter received within a spout of a collapsible bag.
Figure 32:
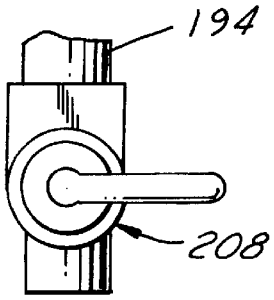
FIG. 32 is a fragmentary view showing a valve on the removable adapter of FIG. 31.

In some applications to facilitate dispensing the contents of a bag, as shown in FIG. 31, an adapter 190 may be installed in the bag spout 20. In use, the spout is received between a retainer ring 204 and an expandable plug assembly 192 in sealing engagement with the spout 20. A suitable plug assembly 192 is commercially available as an "expansion drain plug" sold by U.S. Plastics Corp. This plug assembly has an externally threaded cylindrical tube 194 with an integral radially extending flange 196 at one end, an elastomeric, annular ring 198 received on the tube 194 adjacent the flange 196, a washer 200 received adjacent the ring 198 and a wing nut 202 threadably received on the spout 194 and constructed to be tightened against the washer 200 to axially compress the ring 198 and thereby radially expand the ring 198. As the ring 198 is expanded, the spout 20 is clamped between the radially expanded ring 198 and the external collar or retaining ring 204 received around the spout 20 of the bag 100. A threaded cap 206 closes the end of the tube 194 to control the discharge of the contents of the bag 100 through the discharge spout 194. If desired, as shown in FIG. 32, a flow control valve can be attached to the tube 194 in lieu of the cap 206.

Figure 29:
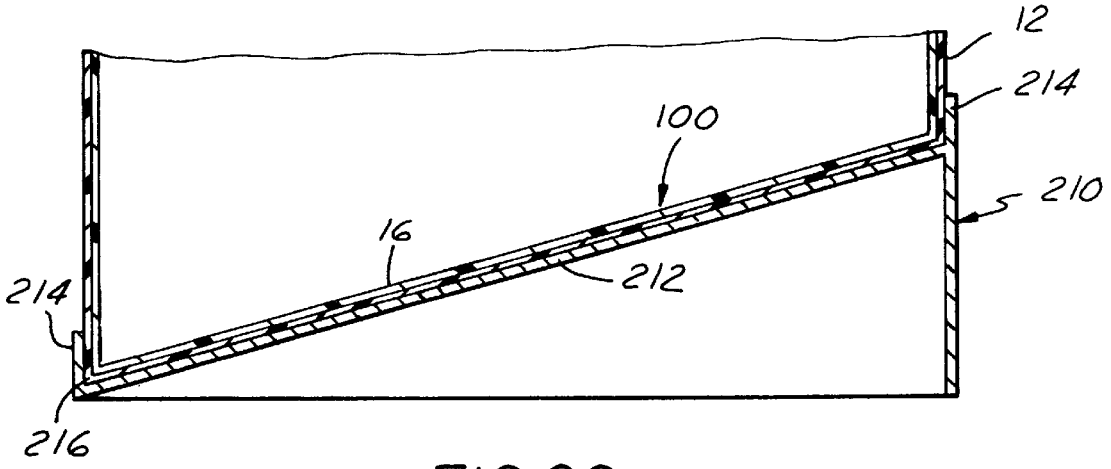
FIG. 29 is a sectional view taken along line 29—29 of FIG. 26.
Figure 30:
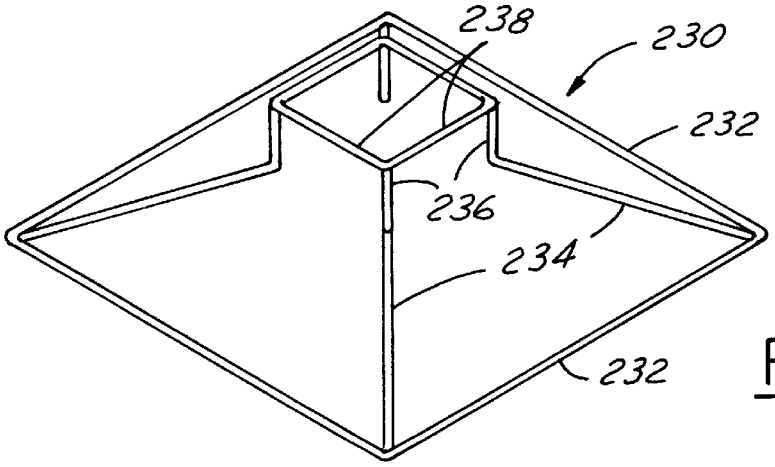
FIG. 30 is a perspective view of the wire frame spout support.

As shown in FIGS. 26 and 29, to facilitate removing the contents of the bag 100, it may be disposed in an open box 12 and place on a base tray 210 with an inclined supporting surface 212 and raised sidewalls 214. The raised sidewall 214 prevents the box 12 from sliding off of the base tray 210. The base tray 210 tilts the box 12 towards one of its corners 216 to provide a sump or lowest corner portion of the bag 100 in the box 12 to facilitate substantially completely emptying the contents of the bag 100. A siphon tube or a pump 220 may be used with a tube 222 extending into the bag 100 adjacent the lowest corner 216 of the box 12 as tilted by the tray 210 to remove substantially all of the liquid contents of the bag.

To facilitate inserting a filling spout, siphon tube or pump tube 222 through the spout 20 of the bag 100, a wire frame support 230 may be provided for the spout 20 of the bag 100. The spout support 230 preferably has a rectangular base 232 disposed about the exterior of the box 12 and spokes 234 extending inwardly from each corner to upstanding legs 236. The legs 236 are interconnected at their upper ends by a wire forming a generally circular or preferably rectangular rack 238 through which the spout 20 may be received and over which the spout 20 may be folded to hold the spout 20 open and in place and prevent the bag 100 from collapsing around the spout during filling or emptying of the bag 100. If necessary, a rubber band 240 or the like may be placed over the spout 20 after it has been folded over the rack 238 to retain the spout on the rack 238.

The cubicle configuration of the bags 10, 100 provides for a container which is easily stackable and which efficiently uses storage or shipping space when disposed side-by-side with adjacent bags 10, 100. Thus, the invention provides a more efficient container for shipping and storing liquids, frozen liquids or flowable solid materials that is less expensive than current five gallon plastic containers, consumes far less space when empty, can be discarded or recycled after use, and which has an integral spout 20 to facilitate filling and discharge of the contents and integral handles 70, 108, 118 to facilitate handling, filling and emptying the bags 10, 100.

While the bags or liners 10, 100 are typically made of a plastic film with heat seals for applications requiring greater strength they may be made of a woven fabric preferably of fibers of polyethylene or polypropylene which is usually sewn or stitched together.

We claim:

1. A supply of collapsible bags comprising:

a plurality of bags formed in an elongated tubular blank of a flexible material;

a perforated portion between adjacent bags of the blank to facilitate separating them;

each bag of the tubular blank when collapsed having a pair of flat overlying panels of the tubular blank that form a pair of opposite sidewalls of the bag and a pair of folded gusset panels extending inwardly between the flat panels from the opposite side edges of the flat panels and adapted to form two other opposite sidewalls of the bag, adjacent one end of the panels each flat panel and the adjacent gusset panel being connected together by a heat seal along lines extending diagonally inwardly from the opposite side edges of the panel from said one end of the panels, said diagonal lines of connection terminating at their laterally inner ends in spaced-apart relation laterally outwardly of the inner folded edges of the gusset panels and at points spaced from said one end of the panels, each flat panel and the adjacent gusset panel also being connected together by a heat seal along a line extending lengthwise of the tubular blank from said points of termination of the diagonal lines to said one end of the panels and each flat panel and the adjacent gusset panel being severed along lines spaced laterally outwardly of and generally coextensive in length with said lengthwise extending heat seal lines of connection to form when the tubular blank is opened a top wall with a spout therein at said one end of the panels, the portions of the flat and gusset panels adjacent said one end of the panels which lie laterally outwardly of the lines of severing being connected together by a heat seal along lines generally transverse to the lines of severing to form integral open loop handles of the bag, adjacent the other end of the panels each flat panel and the adjacent gusset panel being connected together by a heat seal along lines extending generally diagonally inwardly from the opposite side edges of the panels toward said other end of the panels to form when the tubular blank is opened an integral and generally flat bottom wall, when the tubular blank is collapsed each bag folds into a generally flat and compact bag and each bag when separated from the tubular blank and expanded, having a generally cubical configuration with integral and generally rectangular top, flat, bottom and sidewalls and with homogeneously integral open loop handles and a homogeneously integral spout.

2. The collapsible bags of claim 1 wherein the blank is wrapped around itself providing a generally continuous roll of bags.

3. The collapsible bags of claim 1 wherein the bags are received in a container whereby they may be removed from the container one at a time and separated from the adjacent bag.

4. The collapsible bags of claim 1 which also comprises a container and wherein the tubular blank of bags is folded within the container with a pleat adjacent each perforated portion such that the bags overlap each other with each bag laying flat and comprising a separate layer within the container.

5. The collapsible bags of claim 4 wherein the container has more than one compartment with each compartment receiving a separate tubular blank of a plurality of bags.

6. The collapsible bags of claim 1 wherein the open loop handles are integrally formed on opposed sides of the spout.

7. The collapsible bags of claim 1 wherein the plurality of bags are integrally connected in the tubular blank in end-to-end relation such that the bottom wall of one bag is adjacent to the top wall of the next bag.

8. The collapsible bags of claim 1 wherein the bags when in the tubular blank have a first pair of opposed panels and a second pair of gusseted panels received between the first panels.

9. The collapsible bags of claim 8 which also comprise the spout being integrally formed with and extending from the top wall of each bag through which the bag may be filled and emptied.

10. The collapsible bags of claim 8 wherein the open loop handles are integrally formed on opposed sides of the spout.

11. The collapsible bags of claim 1 wherein each open loop handle is integral with the top wall of each bag and formed from a portion of the first and second panels with a cut line provided exteriorly of the portion of each seal line parallel to the longitudinal axis of the tubular blank and a seal line across the handle generally transverse to the longitudinal axis of the tubular blank providing a bight of each open loop handle.

12. The collapsible bags of claim 1 wherein each bag, when expanded, has an interior volume of approximately five-gallons.

13. The collapsible bags of claim 1 which also comprises a panel of material extending from the bottom wall of each bag which may be grasped to facilitate holding the bag and turning the bag upside down.

14. The collapsible bags of claim 13 wherein the panel of material is defined between a pair of spaced apart, parallel seal lines extending across the bag generally perpendicular to the longitudinal axis of the tubular blank.

15. The collapsible bags of claim 14 wherein at least one slit is formed through the panel of material and between the seal lines therein to provide a handle adjacent the bottom of the bags.

16. The collapsible bags of claim 1 which also comprises a slit formed in the bags spaced from the perforated portion and generally adjacent the top of the bags providing a handle adjacent the top of the bags.

17. The collapsible bags of claim 16 which also comprises a heat seal disposed between the perforated portion and the slit and defining the upper portion of the handle.

18. The collapsible bags of claim 1 wherein adjacent said other end of each bag overlapping portions of the flat panels and gusset panels are heat sealed together along a line extending transversely to the axis of the tubular blank and adjacent the perforated portion between adjacent bags to form a reinforced bottom wall of each bag.

19. A supply of collapsible bags comprising:

a plurality of bags formed in an elongated tubular blank of a flexible material;

a perforated portion between adjacent bags of the blank to facilitate separating them;

each bag of the tubular blank when collapsed having a pair of flat overlying panels of the tubular blank that form a pair of opposite sidewalls of the bag and a pair of folded gusset panels extending inwardly between the flat panels from the opposite side edges of the flat panels and adapted to form two other opposite sidewalls of the bag, adjacent one end of the panels each flat panel and the adjacent gusset panel being connected together by a heat seal along lines extending diagonally inwardly from the opposite side edges of the panel from said one end of the panels, said diagonal lines of connection terminating at their laterally inner ends in spaced-apart relation laterally outwardly of the inner folded edges of the gusset panels and at points spaced from said one end of the panels, each flat panel and the adjacent gusset panel also being connected together by a heat seal along a line extending lengthwise of the tubular blank from said points of termination of the diagonal heat seal lines to said one end of the panels and each flat panel and the adjacent gusset panel being severed along lines spaced laterally outwardly of and generally coextensive in length with said lengthwise extending heat seal lines of connection to form when the tubular blank is opened a top wall with a spout therein at said one end of the panels, the portion of the flat and gusset panels adjacent said one end of the panels which lie laterally outwardly of said lines of severing being connected together by a heat seal along lines generally transverse to the lines of severing to form integral handles of the bag, adjacent the other end of the panels each flat panel and the adjacent gusset panel being connected together by a heat seal along lines extending generally diagonally inwardly from the opposite side edges of the panels toward said other end of the panels to form when the tubular blank is opened an integral bottom wall, a panel of the material extending from the bottom wall of each bag which may be grasped to facilitate holding the bag and turning the bag upside down, the panel of material being defined in part between a pair of spaced apart, parallel heat seal lines extending across the bag generally perpendicular to the longitudinal axis of the tubular blank, at least one slit formed through the panel of material and between the pair of spaced apart seal lines therein to provide a handle adjacent the bottom of each bag, and when the tubular blank is collapsed each bag folds into a generally flat and compact bag and each bag when separated from the tubular blank and expanded, having a generally cubical configuration with integral and generally rectangular top, bottom and sidewalls and with homogeneously integral handles and a homogeneously integral spout.

* * * * *